US012419381B1

(12) United States Patent
Chen

(10) Patent No.: US 12,419,381 B1
(45) Date of Patent: Sep. 23, 2025

(54) REPLACEABLE PRESSURE-REDUCING BREATHABLE INSOLE FOR A REHABILITATION BOOT

(71) Applicant: Tung Cheng Chen, Taichung (TW)

(72) Inventor: Tung Cheng Chen, Taichung (TW)

( * ) Notice: Subject to any disclaimer, the term of this patent is extended or adjusted under 35 U.S.C. 154(b) by 0 days.

(21) Appl. No.: 18/605,871

(22) Filed: Mar. 15, 2024

(51) Int. Cl.
*A43B 7/08* (2022.01)
*A43B 3/00* (2022.01)
*A43B 17/08* (2006.01)

(52) U.S. Cl.
CPC ..... *A43B 7/08* (2013.01); *A43B 3/0036* (2013.01); *A43B 17/08* (2013.01)

(58) Field of Classification Search
CPC .. A43B 17/08; A43B 7/06; A43B 7/08; A43B 3/0036
See application file for complete search history.

(56) References Cited

U.S. PATENT DOCUMENTS 2,146,888 A * 2/1939 Fisch ..... A41B 11/005 36/44
2,344,762 A * 3/1944 De ..... A43B 7/06 36/3 R
5,551,173 A * 9/1996 Chambers ..... A43B 7/149 36/141
6,425,194 B1 * 7/2002 Brie ..... A43B 7/141 264/222
2017/0006960 A1 * 1/2017 Martinez ..... A43B 17/003
2019/0014858 A1 * 1/2019 Chen ..... A43B 7/32

* cited by examiner

*Primary Examiner* — Ted Kavanaugh
(74) *Attorney, Agent, or Firm* — WPAT, PC

(57) ABSTRACT

A replaceable pressure-reducing breathable insole for a rehabilitation boot has a body, multiple decompression protrusions, and multiple breathable holes. The body has a top surface, a bottom surface, and a side wall annularly formed between the top surface and the bottom surface of the body to form an outer contour of the body. The decompression protrusions are disposed on and protruded from the bottom surface of the body at spaced intervals, abut against a bottom of the rehabilitation boot to form multiple airways between the bottom of the rehabilitation boot and the bottom surface of the body, and are elastic. The breathable holes are formed through the top surface and the bottom surface of the body at spaced intervals and communicate with the airways between the bottom of the rehabilitation boot and the bottom surface of the body.

15 Claims, 10 Drawing Sheets

REPLACEABLE PRESSURE-REDUCING BREATHABLE INSOLE FOR A REHABILITATION BOOT

BACKGROUND OF THE INVENTION

1. Field of the Invention

The present invention relates to an insole, and more particularly to a replaceable pressure-reducing breathable insole for a rehabilitation boot that can provide a pressure-reducing effect, can be replaced conveniently, and can be used comfortably.

2. Description of Related Art

When a person's limbs, such as arms or calves, are broken, conventional plaster casts or rehabilitation boots are used to hold the broken limbs in position. However, the conventional plaster cast cannot be adjusted again corresponding to recovery conditions of the broken limbs. Although the conventional rehabilitation boots can be adjusted again corresponding to recovery conditions of the broken limb, the conventional rehabilitation boots still have some disadvantages and deficiencies.

With reference to FIG. 10, a conventional rehabilitation boot 50 has a tubular sleeve 51, a bushing cloth 52, and multiple elastic bands 53. The tubular sleeve 51 is configured to wrap a broken limb of a patient and has an opening disposed at a front side of the tubular sleeve 51. The bushing cloth 52 is disposed in the tubular sleeve 51 via the opening to cover and abut against the patient's skin. The elastic bands 53 are detachably connected to the tubular sleeve 51 to hold the patient's broken limb in position between the tubular sleeve 51 and the elastic bands 53. Although the conventional rehabilitation boot 50 can provide a positioning effect to the patient's broken limb, the bushing cloth 52 of the conventional rehabilitation boot 50 cannot provide a pressure-reducing effect when the patient's broken limb touches the ground or impacts against a wall, the reaction force may cause discomfort to the patient.

Furthermore, when fluid from the wound contaminates the bushing cloth 52 or the bushing cloth 52 produces dirty and peculiar odor after the conventional rehabilitation boot 50 has been worn all day long, the patient needs to take the bushing cloth 52 out of the tubular sleeve 51 via the opening to wash and dry the bushing cloth 52. During washing and drying the bushing cloth 52, the patient cannot use the conventional rehabilitation boot 50 temporarily, and this is inconvenient in use.

In addition, since the patient needs to wear the conventional rehabilitation boot 50 for a long time, the bushing cloth 52 with poor breathability may easily cause stuffiness and discomfort to the patient and may cause redness, swelling or allergy problems.

To overcome the shortcomings of the bushing cloth of the conventional rehabilitation boot, the present invention provides a replaceable pressure-reducing breathable insole for a rehabilitation boot to mitigate or obviate the aforementioned problems.

SUMMARY OF THE INVENTION

The main objective of the present invention is to provide a replaceable pressure-reducing breathable insole for a rehabilitation boot that can provide a pressure-reducing effect, can be replaced conveniently, and can be used comfortably.

The replaceable pressure-reducing breathable insole for a rehabilitation boot in accordance with the present invention has a body, multiple decompression protrusions, and multiple breathable holes. The body has a top surface, a bottom surface, and a side wall annularly formed between the top surface and the bottom surface of the body to form an outer contour of the body. The decompression protrusions are disposed on and protruded from the bottom surface of the body at spaced intervals, abut against a bottom of the rehabilitation boot to form multiple airways between the bottom of the rehabilitation boot and the bottom surface of the body, and are elastic. The breathable holes are formed through the top surface and the bottom surface of the body at spaced intervals and communicate with the airways between the bottom of the rehabilitation boot and the bottom surface of the body.

Other objects, advantages, and novel features of the invention will become more apparent from the following detailed description when taken in conjunction with the accompanying drawings.

DETAILED DESCRIPTION OF PREFERRED EMBODIMENTS

Figure 1:
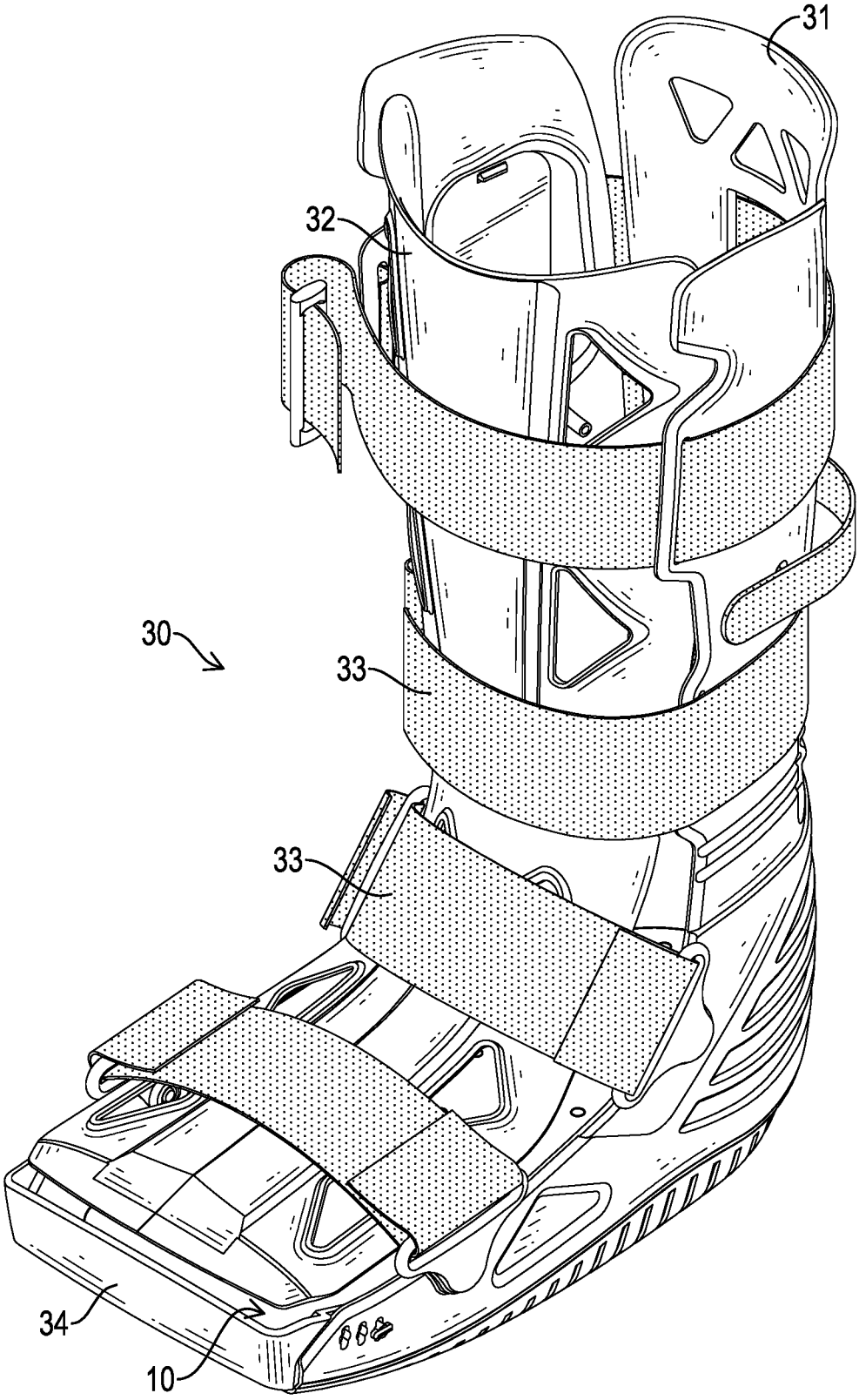
FIG. 1 is a perspective view of a first embodiment of a replaceable pressure-reducing breathable insole for a rehabilitation boot in accordance with the present invention.
Figure 2:
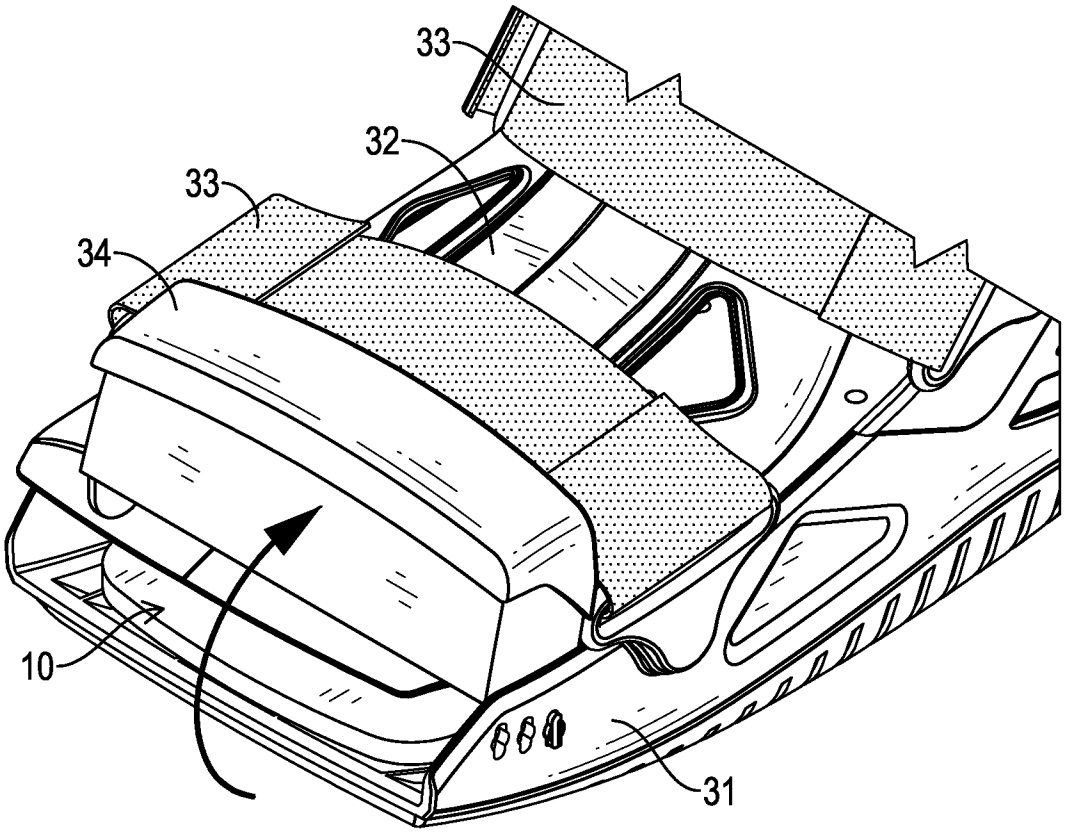
FIG. 2 is an enlarged perspective view in partial section of the replaceable pressure-reducing breathable insole in FIG. 1.

With reference to FIGS. 1 and 2, a first embodiment of a replaceable pressure-reducing breathable insole 10 for a rehabilitation boot in accordance with the present invention is detachably disposed in a rehabilitation boot 30, and the rehabilitation boot 30 has a tubular sleeve 31, a front plate 32, multiple elastic bands 33, and a toe cover 34. The tubular sleeve 31 is configured to wrap a broken limb of a patient and has an opening disposed at a front side of the tubular sleeve 31. The front plate 32 is connected to the tubular sleeve 31 via the elastic bands 33 and covers the opening of the tubular sleeve 31. The elastic bands 33 are detachably connected to the tubular sleeve 31 at spaced intervals and abut the front plate 32 to enable the front plate 32 to cover the opening of the tubular sleeve 31. The toe cover 34 is pivotally connected to a front bottom end of the tubular sleeve 31.

With reference to FIGS. 2 to 5, the first embodiment of the replaceable pressure-reducing breathable insole 10 of the present invention is disposed in the rehabilitation boot 30 between the tubular sleeve 31, the front plate 32, and the toe cover 34, and has a body 11, multiple decompression protrusions 12, and multiple breathable holes 13. The body 11 has an outer contour, a top surface 111, a bottom surface 112, a side wall 113, and at least one curved portion 114. The outer contour of the body 11 corresponds to a contour of a human's foot. The side wall 113 is annularly formed between the top surface 111 and the bottom surface 112 of the body 11 to form the outer contour of the body 11. The at least one curved portion 114 is formed in the side wall 113 between the top surface 111 and the bottom surface 112 of the body 11 to form a gap between the tubular sleeve 31 and the front plate 32. When a patient wears the rehabilitation boot 30, the gap formed by the at least one curved portion 114 can provide ventilation and heat dissipation effects between the tubular sleeve 31 and the front plate 32. Preferably, with reference to FIG. 4, in the first embodiment of the present invention, the body 11 has two curved portions 114 formed at a front end of the body 11 at an interval to form two gaps between the tubular sleeve 31 and the front plate 32.

Figure 4:
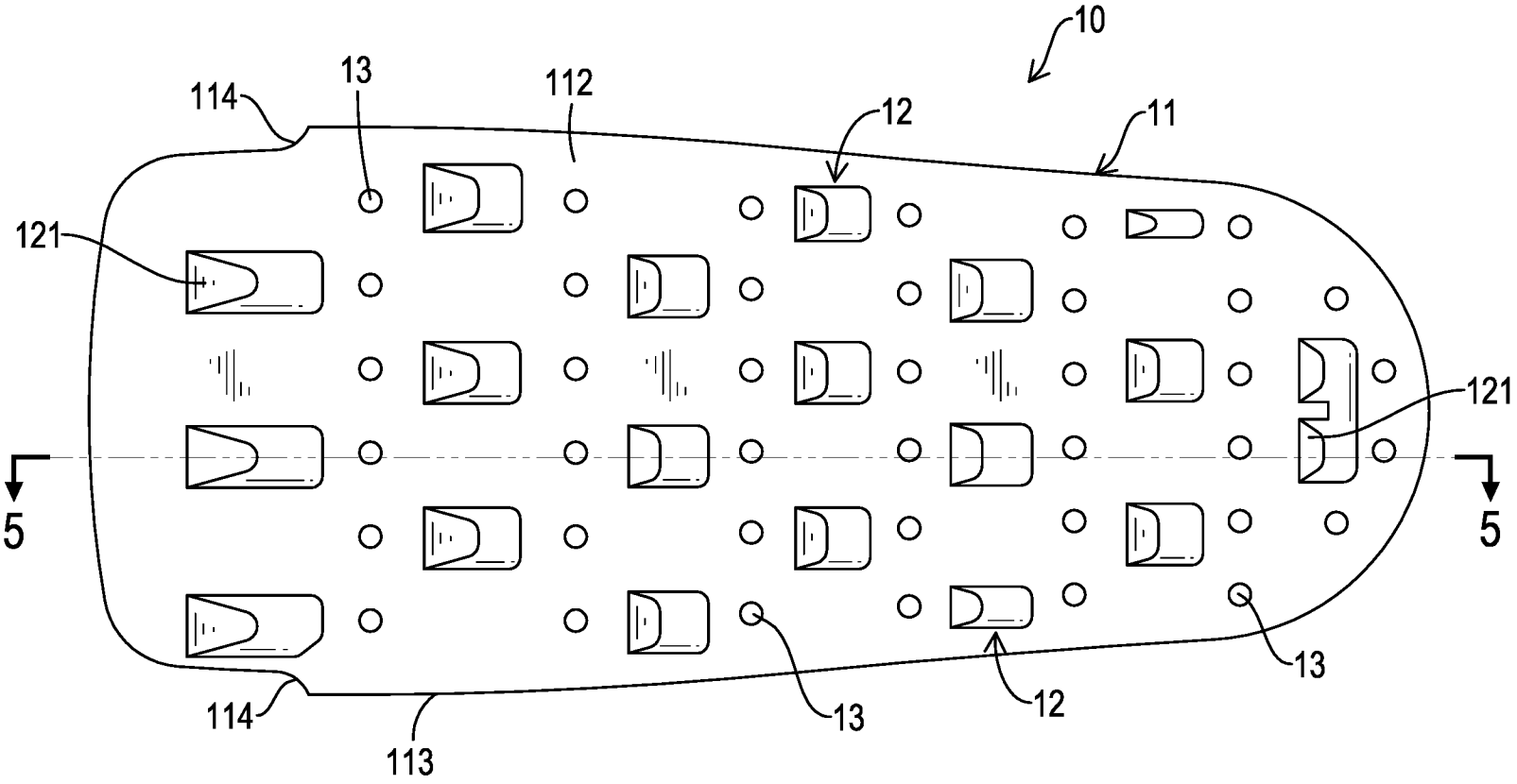
FIG. 4 is an enlarged bottom side view of the replaceable pressure-reducing breathable insole in FIG. 1.
Figure 5:
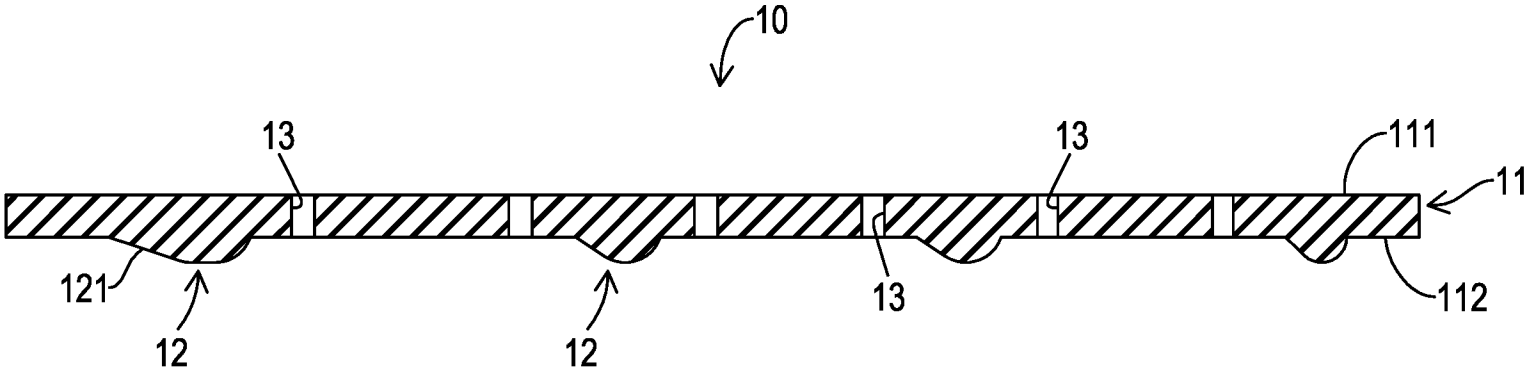
FIG. 5 is an enlarged cross sectional side view of the replaceable pressure-reducing breathable insole across line 5-5 in FIG. 4.

With reference to FIGS. 4 and 5, the decompression protrusions 12 are disposed on and protruded from the bottom surface 112 of the body 11 at spaced intervals, and abut against a bottom side of the tubular sleeve 31 to form multiple airways between the bottom side of the tubular sleeve 31 and the bottom surface 112 of the body 11. Each one of the decompression protrusions 12 is elastic, may be elongated in shape, and has an inclined face 121 and a curved face. With reference to FIG. 5, the inclined face 121 is obliquely formed on a front side of the decompression protrusion 12 and cooperates with a moving direction of the rehabilitation boot 30 to increase a contacting area to reduce pressure. The curved face is formed on a rear side of the decompression protrusion 12, is formed with the inclined face 121, and abuts against the bottom of the rehabilitation boot 30 to allow the decompression protrusion 12 to elastically deform. Furthermore, since the decompression protrusions 12 are independently disposed on the bottom surface 112 of the body 11, each one of the decompression protrusions 12 is deformed independently without interfering with the adjacent decompression protrusions 12, and this enables each one of the decompression protrusions 12 to provide different deformations with different pressure-reducing effects.

In addition, the decompression protrusions 12 disposed on the bottom surface 112 of the body 11 are arranged in a matrix, and the decompression protrusions 12 in each two adjacent rows of the matrix are misaligned, and this enables the airways between the bottom surface 112 of the body 11 and the bottom side of the tubular sleeve 31 to intersect with one another to improve effects of ventilation and heat dissipation.

Figure 6:
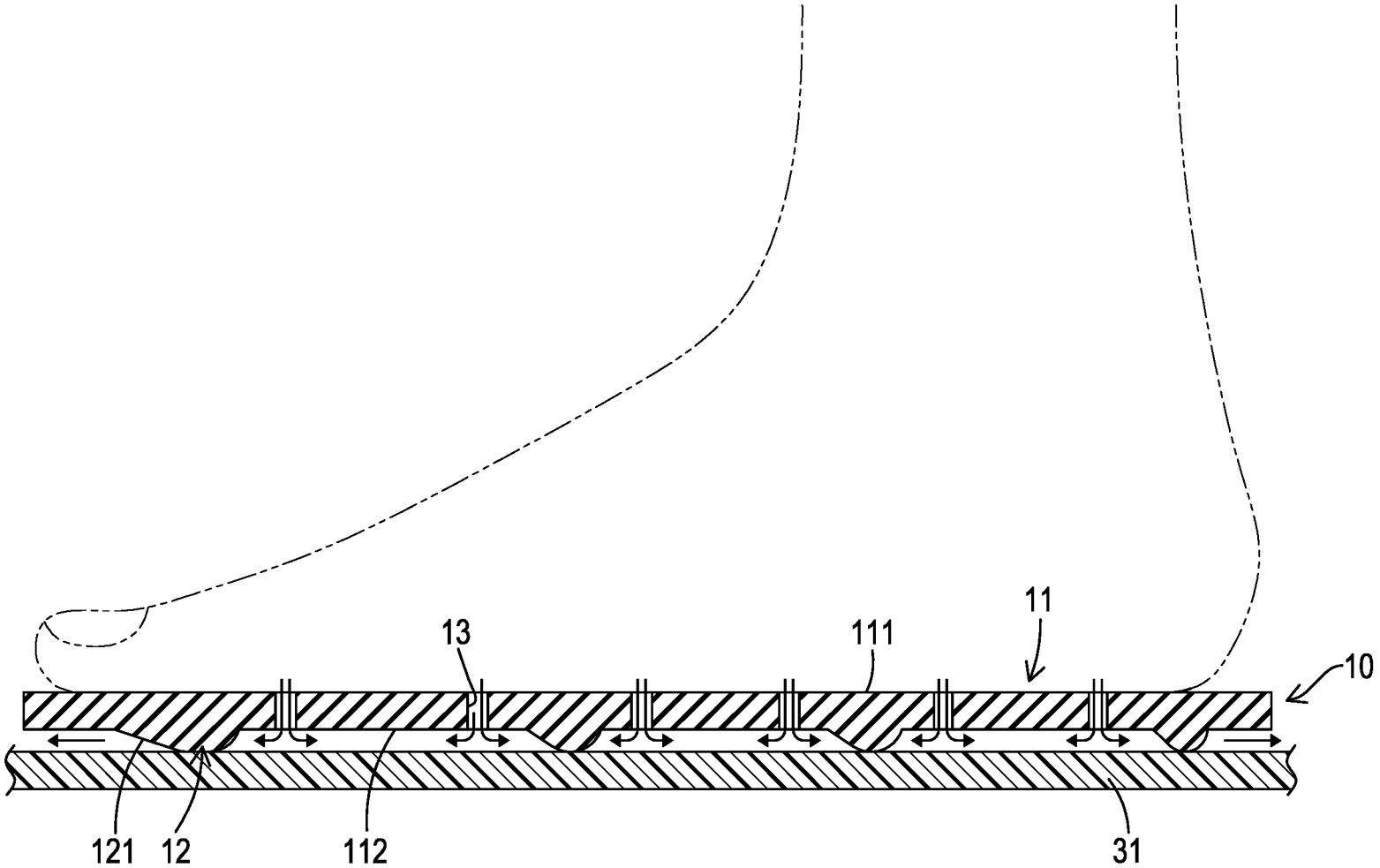
FIG. 6 is an operational and cross sectional side view of the replaceable pressure-reducing breathable insole in FIG. 1.

With reference to FIG. 6, when a patient wares the rehabilitation boot 30 and steps on the replaceable pressure-reducing breathable insole 10 of the present invention, each one of the decompression protrusions 12 is deformed according to the pressure it endures to absorb the reaction force from the ground to provide a pressure-reducing effect to the patient and to reduce pressure on the patient's foot. Additionally, with the matrix and misalignment of the decompression protrusions 12, the airways between the bottom surface 112 of the body 11 and the bottom side of the tubular sleeve 31 can effectively provide ventilation and heat dissipation effects, and the patient can wear the rehabilitation boot 30 with the replaceable pressure-reducing breathable insole 10 comfortably. Preferably, each one of the decompression protrusions 12 is formed on and protrudes from the bottom surface 112 of the body 11. Furthermore, the replaceable pressure-reducing breathable insole 10 may be made of ethylene vinyl acetate copolymer (EVA) with Shore hardness of material of 45 A.

Figure 3:
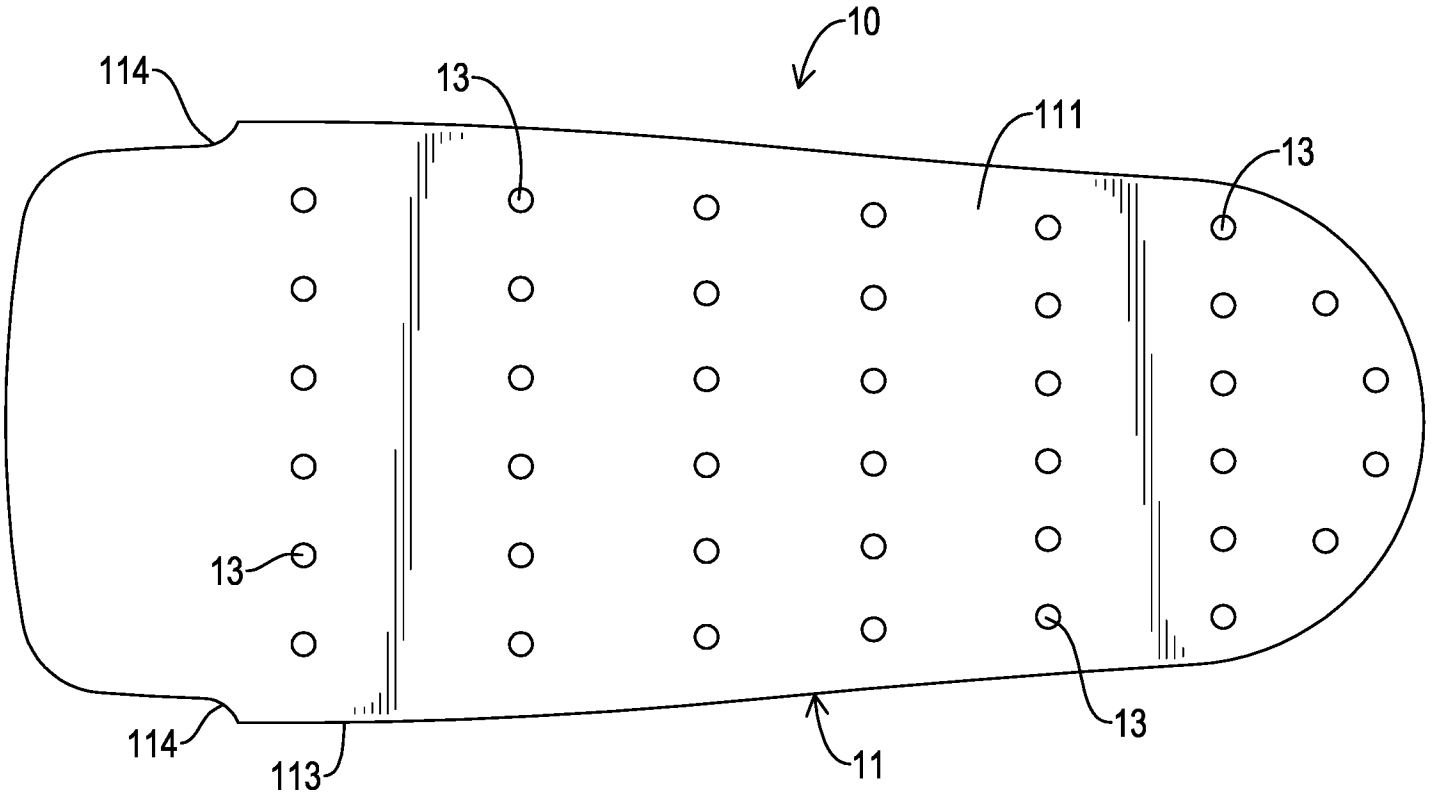
FIG. 3 is an enlarged top side view of the replaceable pressure-reducing breathable insole in FIG. 1.

With reference to FIGS. 3 to 5, the breathable holes 13 are formed through the top surface 111 and the bottom surface 112 of the body 11 at spaced intervals and communicate with the airways between the bottom side of the tubular sleeve 31 and the bottom surface 112 of the body 11. Furthermore, with reference to FIGS. 3 and 4, the breathable holes 13 are formed through the body 10 between each two adjacent rows of the decompression protrusions 12 and align with each other.

Figure 7:
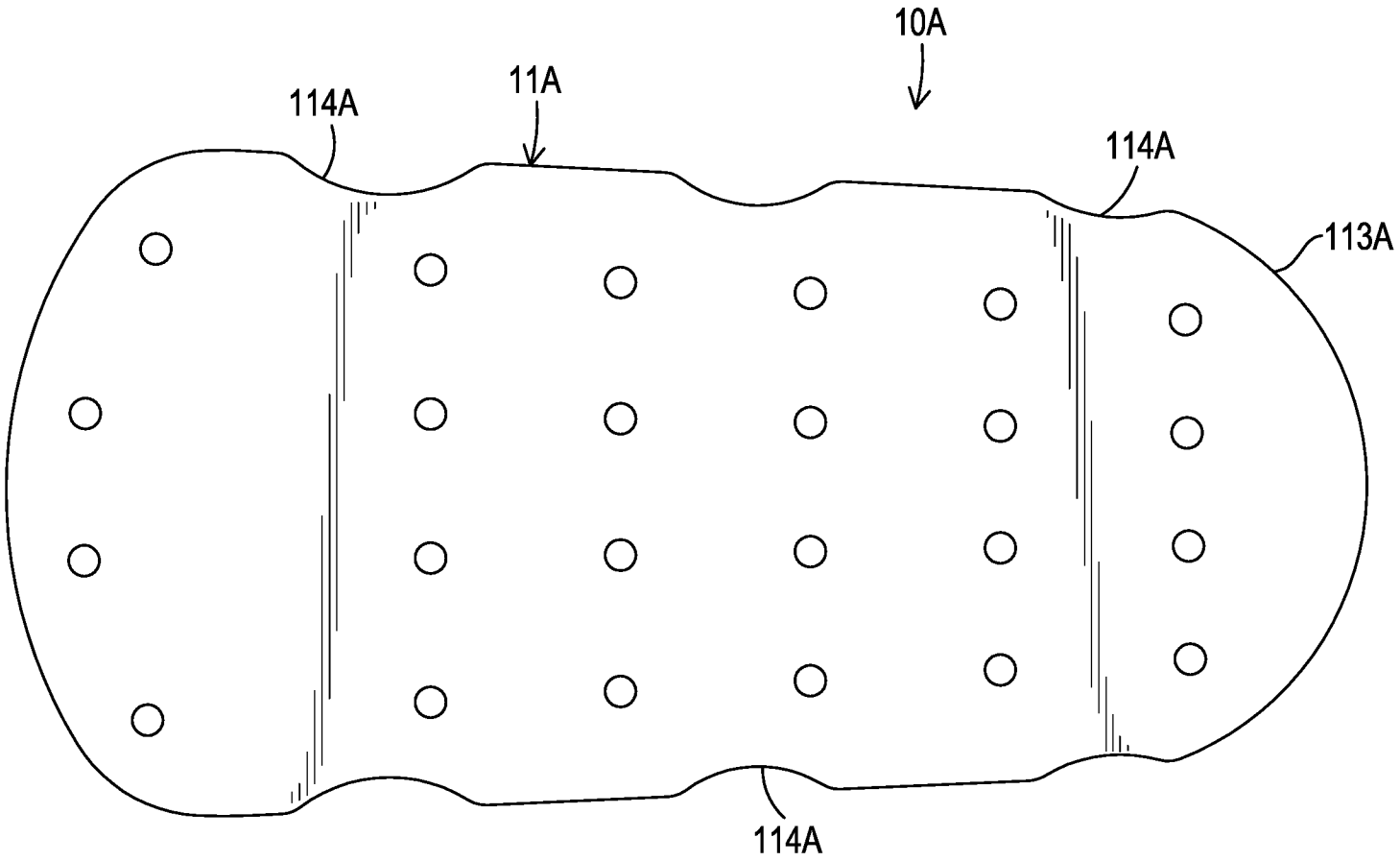
FIG. 7 is an enlarged top side view of a second embodiment of a replaceable pressure-reducing breathable insole for a rehabilitation boot in accordance with the present invention.
Figure 8:
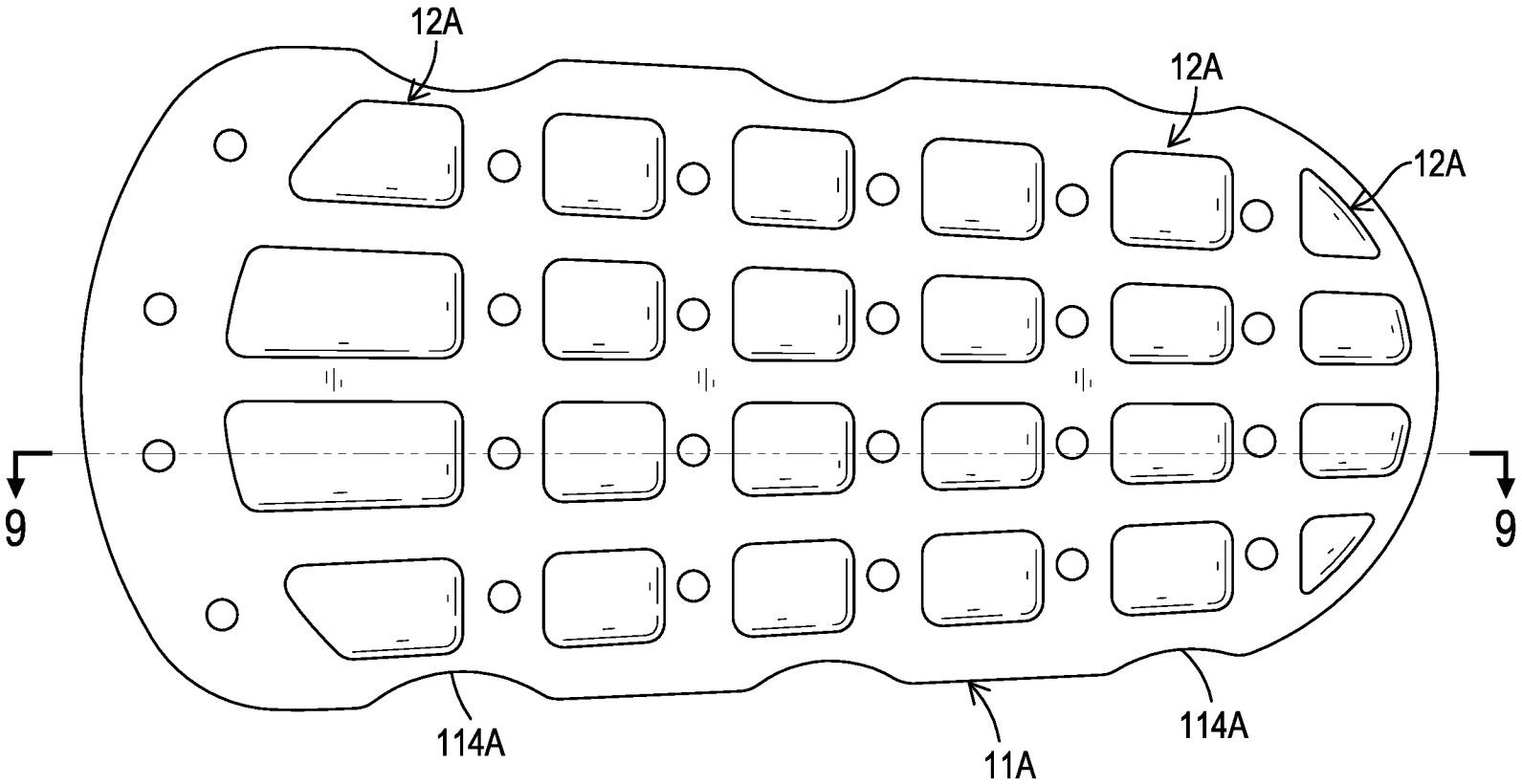
FIG. 8 is an enlarged bottom side view of the replaceable pressure-reducing breathable insole in FIG. 7.
Figure 9:
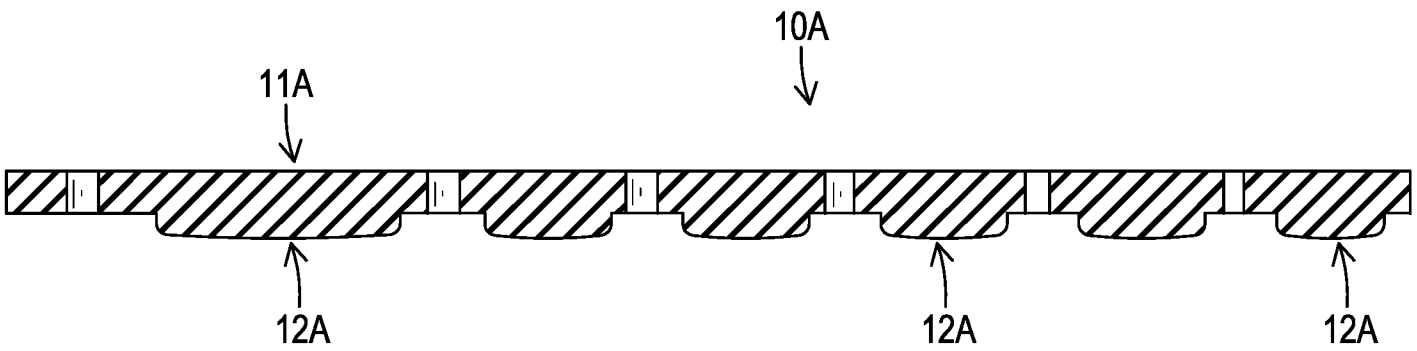
FIG. 9 is an enlarged cross sectional side view of the replaceable pressure-reducing breathable insole across line 9-9 in FIG. 8.
Figure 10:
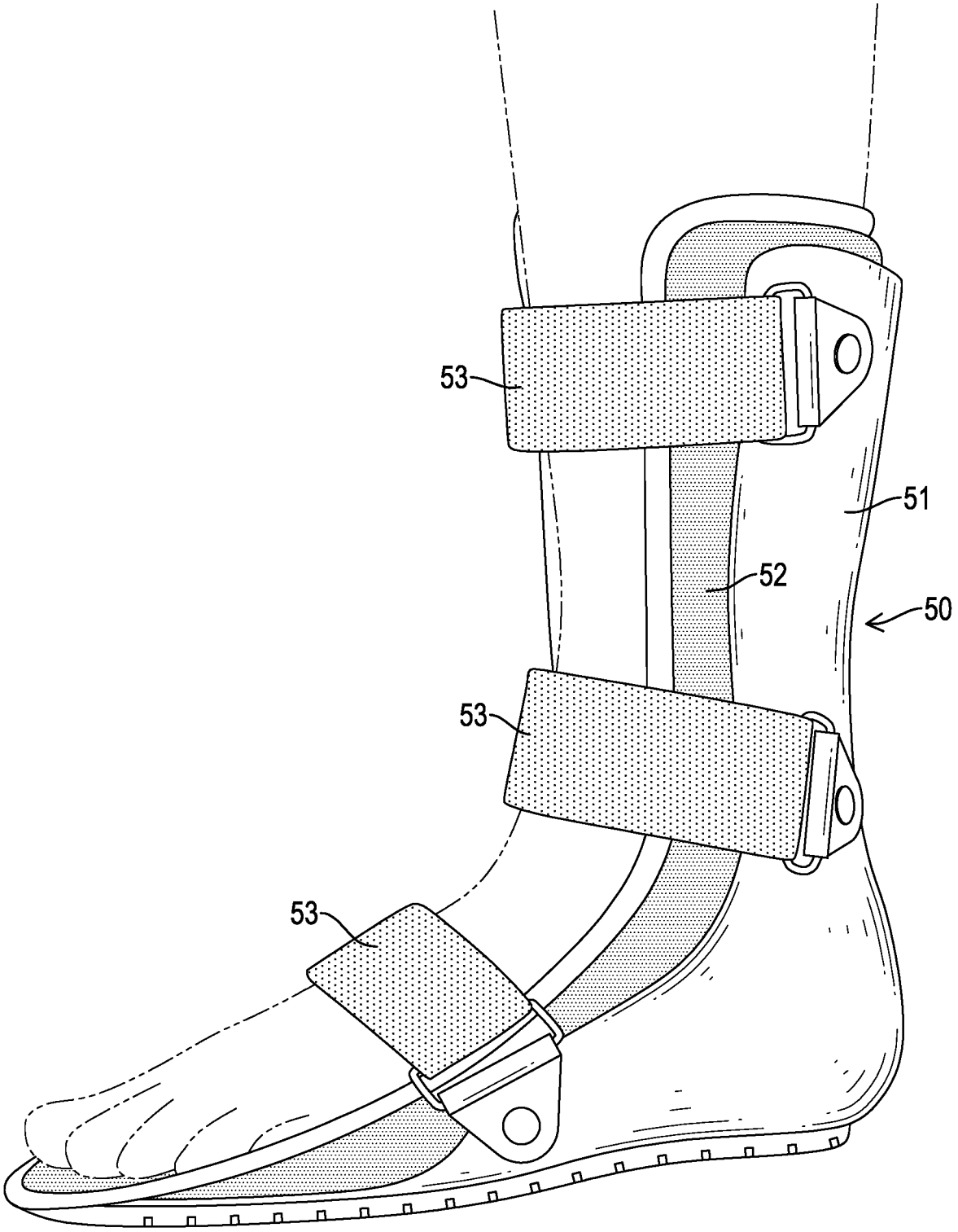
FIG.10 PRIOR ART
FIG. 10 is an operational side view of a rehabilitation boot in accordance with the prior art.

With reference to FIGS. 6 to 8, a second embodiment of a replaceable pressure-reducing breathable insole 10A for a rehabilitation boot in accordance with the present invention is substantially the same as the first embodiment except for the following features. In the second embodiment of the present invention, the body 11A has six curved portions 114A formed in the side wall 113A at spaced interval to form six gaps between the tubular sleeve 31 and the front plate 32. In addition, with reference to FIG. 8, the shape of each one of the decompression protrusions 12 may be polygonal, such as rectangle, triangle or trapezoid, etc. Each one of the decompression protrusions 12 does not have an inclined face formed on the front side of the decompression protrusion 12. Furthermore, the decompression protrusions 12 in each two adjacent rows of the matrix are aligned with each other.

According to the above-mentioned features and structural relationships of the replaceable pressure-reducing breathable insole 10, 10A for a rehabilitation boot 30 of the present invention, the present invention has the following advantages:

First, the decompression protrusions 12, 12A on the bottom surface 112 of the body 11, 11A are independently disposed on the bottom surface 112 of the body 11, 11A, each one of the decompression protrusions 12, 12A can be deformed independently without interfering with the adjacent decompression protrusions 12, 12A, and this enables each one of the decompression protrusions 12 to provide different deformations with different pressure-reducing effects to support the weight of the patient. The elasticities of the decompression protrusions 12, 12A make the replaceable pressure-reducing breathable insole 10, 10A more comfortable to wear, and can also absorb part of the reaction force from the ground when walking and reduce the pressure on the patient's foot.

Second, when fluid from the wound contaminates the replaceable pressure-reducing breathable insole 10, 10A or the replaceable pressure-reducing breathable insole 10, 10A produces dirty and peculiar odor after the patient has been wearing the rehabilitation boot 30 all day, the patient can easily take the replaceable pressure-reducing breathable insole 10, 10A out of the tubular sleeve 31 via the opening to wash and dry the replaceable pressure-reducing breathable insole 10, 10A. During washing and drying the replaceable pressure-reducing breathable insole 10, 10A, the patient can replace a new one of the replaceable pressure-reducing breathable insole 10, 10A into the rehabilitation boot 30 and continue to use the rehabilitation boot 30, and this is convenient in use, ensures the hygiene of the feet, and prevent secondary infection.

Third, the replaceable pressure-reducing breathable insole 10, 10A for the rehabilitation boot 30 is made of EVA with Shore hardness of material of 45 A, which is lightweight, elastic, and comfortable to wear.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A replaceable pressure-reducing breathable insole for a rehabilitation boot comprising:

a body having a top surface;

a bottom surface; and a side wall annularly formed between the top surface and the bottom surface of the body to form an outer contour of the body;

multiple decompression protrusions disposed on and protruded from the bottom surface of the body at spaced intervals, configured to abut against a bottom of the rehabilitation boot to form multiple airways between the bottom of the rehabilitation boot and the bottom surface of the body, being elastic, and each one of the decompression protrusions having an inclined face obliquely formed on a front side of the decompression protrusion and configured to cooperate with a moving direction of the rehabilitation boot to increase a contacting area to reduce pressure; and a curved face formed on a rear side of the decompression protrusion, formed with the inclined face, and configured to abut against the bottom of the rehabilitation boot to allow the decompression protrusion to elastically deform; and multiple breathable holes formed through the top surface and the bottom surface of the body at spaced intervals and communicating with the airways between the bottom of the rehabilitation boot and the bottom surface of the body.

2. The replaceable pressure-reducing breathable insole for a rehabilitation boot as claimed in claim 1, wherein the body has at least one curved portion formed in the side wall between the top surface and the bottom surface of the body configured to form a gap in the rehabilitation boot.

3. The replaceable pressure-reducing breathable insole for a rehabilitation boot as claimed in claim 2, wherein each one of the decompression protrusions is formed on and protrudes from the bottom surface of the body.

4. The replaceable pressure-reducing breathable insole for a rehabilitation boot as claimed in claim 2, wherein the replaceable pressure-reducing breathable insole is made of ethylene vinyl acetate copolymer with Shore hardness of material of 45 A.

5. The replaceable pressure-reducing breathable insole for a rehabilitation boot as claimed in claim 2, wherein the body has multiple curved portions formed in the side wall of the body at spaced intervals configured to form multiple gaps in the rehabilitation boot.

6. The replaceable pressure-reducing breathable insole for a rehabilitation boot as claimed in claim 5, wherein each one of the decompression protrusions is formed on and protrudes from the bottom surface of the body.

7. The replaceable pressure-reducing breathable insole for a rehabilitation boot as claimed in claim 1, wherein the decompression protrusions disposed on the bottom surface of the body are arranged in a matrix.

8. The replaceable pressure-reducing breathable insole for a rehabilitation boot as claimed in claim 7, wherein each one of the decompression protrusions is formed on and protrudes from the bottom surface of the body.

9. The replaceable pressure-reducing breathable insole for a rehabilitation boot as claimed in claim 4, wherein the decompression protrusions in each two adjacent rows of the matrix are misaligned.

10. The replaceable pressure-reducing breathable insole for a rehabilitation boot as claimed in claim 9, wherein each one of the decompression protrusions is formed on and protrudes from the bottom surface of the body.

11. The replaceable pressure-reducing breathable insole for a rehabilitation boot as claimed in claim 9, wherein the breathable holes are formed through the body between each two adjacent rows of the decompression protrusions and align with each other.

12. The replaceable pressure-reducing breathable insole for a rehabilitation boot as claimed in claim 7, wherein each one of the decompression protrusions is elongated in shape.

13. The replaceable pressure-reducing breathable insole for a rehabilitation boot as claimed in claim 11, wherein each one of the decompression protrusions is polygonal in shape.

14. The replaceable pressure-reducing breathable insole for a rehabilitation boot as claimed in claim 1, wherein each one of the decompression protrusions is formed on and protrudes from the bottom surface of the body.

15. The replaceable pressure-reducing breathable insole for a rehabilitation boot as claimed in claim 1, wherein the replaceable pressure-reducing breathable insole is made of ethylene vinyl acetate copolymer with Shore hardness of material of 45 A.

* * * * *